US007498998B2

(12) United States Patent
Suzuki et al.

(10) Patent No.: US 7,498,998 B2
(45) Date of Patent: Mar. 3, 2009

(54) ANTENNA DEVICE

(75) Inventors: Takumi Suzuki, Akita (JP); Shozo Miyamoto, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 33 days.

(21) Appl. No.: 11/616,495

(22) Filed: Dec. 27, 2006

(65) Prior Publication Data

US 2008/0018549 A1 Jan. 24, 2008

(30) Foreign Application Priority Data

Jan. 31, 2006 (JP) ..... P2006-23387

(51) Int. Cl.
*H01Q 1/52* (2006.01)

(52) U.S. Cl. ..... 343/841; 343/713

(58) Field of Classification Search ..... 343/711, 343/712, 713, 700 MS, 841
See application file for complete search history.

(56) References Cited

U.S. PATENT DOCUMENTS

2003/0118927 A1* 6/2003 Nakamura et al. ..... 430/65
2003/0231137 A1* 12/2003 Du et al. ..... 343/713
2005/0104781 A1* 5/2005 Notohara et al. ..... 343/700 MS
2006/0032668 A1* 2/2006 Wakihara et al. ..... 174/260
2006/0154052 A1* 7/2006 Waffenschmidt et al. .... 428/339

FOREIGN PATENT DOCUMENTS

JP 2001-24428 1/2001

* cited by examiner

*Primary Examiner*—HoangAnh T Le
(74) *Attorney, Agent, or Firm*—Whitham Curtis Christofferson & Cook, PC

(57) ABSTRACT

A circuit board has a first face and a second face opposite to the first face. An electronic component is mounted on the second face. An insulative sheet is disposed between the first face of the circuit board and an antenna and having an electromagnetic shielding property.

6 Claims, 2 Drawing Sheets

ANTENNA DEVICE

The disclosure of Japanese Patent Application No. 2006-23387 filed Jan. 16, 2006 including specification, drawings and claims is incorporated herein by reference in its entirety.

BACKGROUND

The present invention relates to an antenna applied to a receiving apparatus operable to receive signals transmitted from an artificial satellite.

Recently, digital radio receivers operable to receive satellite waves or ground waves have been developed. A user can listen to radio broadcasts with these digital radio receivers. These digital radio receivers have been put into practical use in the United States. These digital radio receivers are mounted on mobile stations such as automobiles and operable to receive electric waves, the frequencies of which are in the frequency band of about 2.3 GHz. That is, the digital radio receiver is capable of listening to mobile radio broadcasts. Since the frequency of the electric waves to be received is about 2.3 GHz, the receiving wave-length (the resonance wave-length) $\lambda$ is about 128.3 mm. In a case where these digital radio receivers receive ground waves, the ground waves are transmitted in such a manner that satellite waves are first received by a global station and then transmitted again by linear polarization after the frequency has been slightly shifted.

This type of receiving system for receiving satellite waves or ground waves includes an antenna device and a radio tuner. The antenna device receives satellite waves or ground waves and then outputs a receiving signal of high frequency. The radio tuner demodulates the receiving signal and outputs a voice signal.

In the related-art antenna device, for example, it is possible to use a plane antenna disclosed in Japanese Patent Publication No. 2001-24428. The plane antenna disclosed in Japanese Patent Publication No. 2001-24428 includes: an upper case; a plane antenna element arranged on a reverse side of the upper case while a predetermined interval is being formed between the plane antenna element and the reverse side of the upper case; a ground sheet arranged while a predetermined interval is formed between the ground sheet and the plane antenna element; a feeding conductor arranged between the plane antenna element and the ground sheet; a circuit board attached to a lower face of the ground sheet; and electronic parts mounted on the circuit board.

In the related-art antenna device, it is necessary to provide a ground sheet used for antenna emission which is arranged separately from the circuit board. On the other hand, the ground sheet is attached to one side of the circuit board and electronic parts are mounted on the other side of the circuit board.

The circuit board is a printed board on which a control circuit and an information processing circuit used for communication are mounted. On the circuit board, a CPU for controlling the overall antenna device and a high frequency oscillator for supplying a high frequency signal to an antenna wire or an antenna face are mounted. That is, on the same board, the digital circuit and the analog circuit exists while being mixed with each other.

From such a circuit board, electromagnetic noise is emitted. The emitted electromagnetic noise spreads in a space. On the other hand, an insulating material is inserted into a gap formed between the circuit board and the ground sheet used for antenna emission. However, it is inevitable that an electric potential difference is generated between a ground electric potential of the circuit board and a ground electric potential of the ground sheet for antenna emission. Further, it is inevitable that a fluctuation is caused in the electric potential difference. Due to this fluctuation of the electric potential difference, electromagnetic noise generated from the circuit board enters the antenna element and a performance of the antenna device is deteriorated.

Therefore, in the related-art antenna device, it is necessary to interpose an electromagnetic shielding sheet and an insulator sheet between the ground sheet for antenna emission and the circuit board. Therefore, it becomes difficult to reduce the size of the antenna device. Further, it becomes difficult to reduce the thickness of the antenna device.

SUMMARY

It is therefore an object of the invention to provide an antenna device having a function of electromagnetic shielding and also having a function of insulation between the antenna which includes the antenna element and the ground sheet for emission, and the circuit board while being capable of reducing the size and thickness.

In order to achieve the above described object, according to the invention, there is provided an antenna device, comprising:

a circuit board, having an first face and a second face opposite to the first face;

an electronic component, mounted on the second face;

an antenna; and an insulative sheet, interposed between the first face of the circuit board and the antenna and having an electromagnetic shielding property.

The insulative sheet may include a sheet-shaped conductor having a third face and a fourth face opposite to the third face, a sheet-shaped first insulator integrally laminated on the third face, and a sheet-shaped second insulator integrally laminated on the fourth face.

The sheet-shaped conductor may be comprised of at least one of carbon, a metallic material and a composite material of the carbon and the metallic material. And the first insulator and the second insulator may be comprised of at least one of polyethylene terephthalate, polyethersulfone, polyvinyl chloride, polycarbonate, polypropylene and polyethylene.

The insulative sheet may include a first film comprised of non-conductive polymer and having a third face, a metallic conductive film which is vapor-deposited on the fourth face, and a second film comprised of the non-conductive polymer, covering the metallic conductive film and integrally laminated on the third face.

The insulative sheet may include a sheet-shaped electromagnetic shielding member comprised of magnetic substance powder hardened by high polymer material, and sheet-shaped insulative member comprised of non-conductive material and integrally laminated on both faces of the electromagnetic shielding sheet.

The antenna may include an antenna element comprised of a metal sheet and a ground sheet. The insulative sheet may be interposed between the first face of the circuit board and the ground sheet. The ground sheet, the insulative sheet, and the circuit board may be formed integrally.

The insulative sheet may be flexible.

In the antenna device of the invention, an insulating sheet having an electromagnetic shielding function is arranged between the antenna element and the circuit board so that the antenna element can not be affected by electromagnetic noise generated by the circuit board even when a fluctuation of the ground electric potential is caused between the antenna and the circuit board. With this configuration, the size and the thickness of the antenna device can be reduced. Further, the manufacturing cost can be reduced.

An object of reducing the size and thickness of the antenna device is accomplished by arranging one insulating sheet having an electromagnetic shielding function between the antenna and the circuit board.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, an embodiment of an antenna device according to the invention will be discussed with reference to the accompanying drawings.

Figure 1:
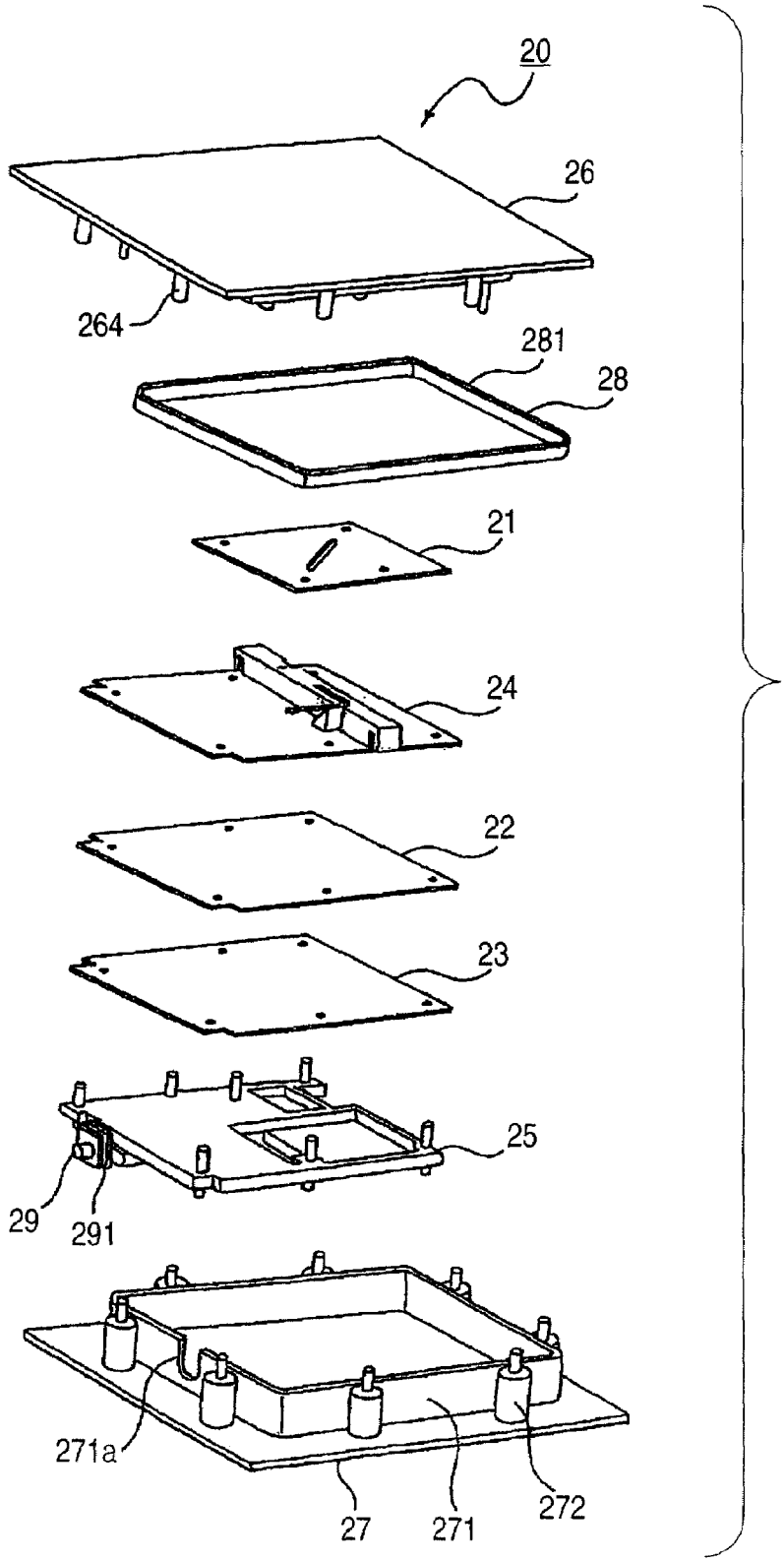
FIG. 1 is an exploded perspective view showing an antenna device according to an embodiment of the invention.

As shown in FIG. 1, the antenna device 20 includes: an antenna element 21; a thin insulating sheet 22; a circuit board 23; a ground sheet 24, on the upper side of which a feeding conductor is mounted; a metallic cover 25; an upper case 26; a lower case 27; a packing member 28; and a bushing 29. The antenna includes the antenna element 21 and the ground sheet 24.

Figure 2:
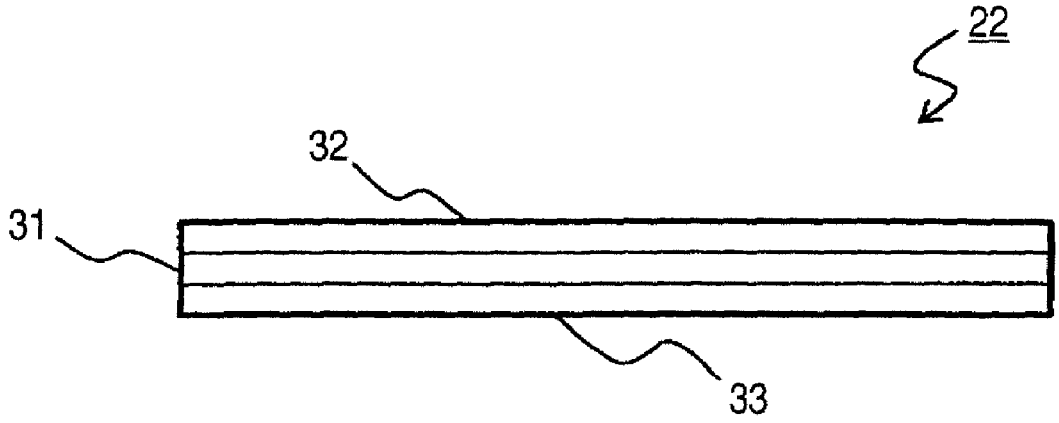
FIG. 2 is a side view showing a thin insulating sheet having an electromagnetic shielding function according to the embodiment of the invention.

The thin insulating sheet 22 is a thin sheet having an electromagnetic shielding function. The thin insulating sheet 22 tightly sticks to and between the ground sheet 24 of the antenna element 21 and the reverse side of the circuit board 23. Due to this thin insulating sheet 22, the entire thickness of the antenna device is reduced. Therefore, a reduction of the size and thickness of the antenna device can be realized. The detail will be explained later referring to FIG. 2.

The antenna device 20 is a plane antenna. The plane antenna element 21 is formed out of a rectangular metallic sheet. The plane antenna element 21 has a receiving face for receiving satellite waves or ground waves. The circuit board 23 is arranged in parallel with this plane antenna element 21 while a predetermined interval is being formed between the circuit board 23 and the plane antenna element 21. Between the plane antenna element 21 and the circuit board 23, a ground sheet 24 for antenna emission is arranged. A feeding conductor is mounted on the face of the ground sheet in the plane antenna element 21 side. The antenna element 21 and the ground sheet 24, on which the feeding conductor is mounted, compose an antenna through a space.

Various electronic parts including a CPU are arranged on the opposite side to the plane antenna element 21 of the circuit board 23. These various electronic parts are covered with a metallic cover 25 used for electromagnetic shielding. The components described above are accommodated in a case formed by the upper case 26 and the lower case 27. In this connection, reference numeral 28 is a packing member and reference numeral 29 is a bushing formed of a cable and bushing.

The packing member 28 has an annular groove 281. The upper case 26 has a wall portion (not illustrated in the drawing because it is arranged on a reverse side of the upper case) which is formed integrally with the upper case 26 and annularly protruded to a periphery of the antenna unit. The packing member 28 is attached in such a manner that the wall portion of the upper case 26 is inserted into the groove 281 of the packing member 28. Therefore, the packing member 28 composes a water-proof structure when it is crushed between the wall portion of the upper case 26 and the wall portion 271 integrally formed on the inner wall of the lower case 27.

In the periphery of the wall portion of the upper case 26, eight columnar members 264 are integrally arranged. In the lower case, at positions corresponding to these columnar members 264, columnar members 272 are arranged. When both the columnar members 264, 272 are screwed to each other, the upper case 26 and the lower case 27 are fixed to each other.

In the wall portion 271 of the lower case 27, a U-shaped cutout portion 271*a*, into which the bushing 29 including the cable is press-fitted, is formed. The bushing 29 has a U-shaped groove 291 into which the cutout portion 271*a* of the lower case 27 is inserted. The packing member 28 is crushed by an upper face of the bushing 29 so that a water-proof structure can be composed.

Next, the thin insulating sheet 22 will be explained below. The thin insulating sheet 22 has a laminate structure in which the sheet-shaped insulators 32, 33 are laminated on both sides of the sheet-shaped conductor 31 so that the sheet-shaped insulators 32, 33 and the sheet-shaped conductor 31 can be formed into one thin sheet. The sheet-shaped conductor 31 is made of, for example, carbon. The sheet-shaped insulators 32, 33 are made of non-conductive high polymer, which has been widely put into practical use in these days, for example, PET (polyethylene terephthalate).

The conductive material is not limited to carbon. The conductive material includes metallic material such as alloy and its compound material. The insulating material is not limited to organic polymer of PET. The insulating material include PES (polyethersulfone), PVC (polyvinyl chloride), PC (polycarbonate), PP (polypropylene) and PE (polyethylene).

These conductive materials and insulating materials can be easily formed into a film shape and laminated onto each other. Therefore, it is possible to form one insulating sheet having an electromagnetic shielding function performed by the conductive sheet.

The thin insulating sheet provided between the ground sheet 24 for antenna emission and the circuit board 23 has a laminate structure in which the sheet-shaped insulators are laminated on both sides of the sheet-shaped conductor. Therefore, it is possible for the ground sheet 24 for antenna emission and the circuit board 23 to be tightly stuck to each other. Therefore, it is possible to realize a reduction of the size and thickness of the antenna device.

The thin insulating sheet may be formed integrally into one sheet having a laminate structure in which a metallic conductive film is vapor-deposited on one face of a film made of non-conductive high polymer material and further this metallic conductive film is covered with another film made of non-conductive high polymer and tightly stuck to it so that the films can be laminated on each other. In addition, the thin insulating sheet may be flexible.

It is possible to compose one sheet having a laminate structure in which non-conductive insulating sheets are laminated on both sides of a thin electromagnetic shielding sheet on which magnetic powder is tightened with high polymer material.

In the above explanations, materials of the conductor and insulator are restricted. However, as long as materials can be applied for making a laminate structure, any materials may be used, that is, materials are not limited to the specific materials explained above.

In the invention, one thin insulating sheet having an electromagnetic shielding function is arranged between the ground sheet which composes the antenna, and the circuit board and these components can be integrated with each other into one body. Therefore, the invention can be applied to an antenna device, the size and thickness of which must be reduced, having a structure in which an insulator is provided between the ground sheet for antenna emission and the circuit board.

What is claimed is:

1. An antenna device, comprising:

a circuit board, having a first face and a second face opposite to the first face;

an electronic component, mounted on the second face;

an antenna including an antenna element and a ground sheet; and an insulative sheet, disposed between the first face of the circuit board and the ground sheet of the antenna and having an electromagnetic shielding property, wherein the insulative sheet includes a sheet-shaped conductor having a third face and a fourth face opposite to the third face, a sheet-shaped first insulator integrally laminated on the third face, and a sheet-shaped second insulator integrally laminated on the fourth face.

2. The antenna device as set forth in claim 1, wherein:

the sheet-shaped conductor is comprised of at least one of carbon, a metallic material and a composite material of the carbon and the metallic material; and the first insulator and the second insulator are comprised of at least one of polyethylene terephthalate, polyethersulfone, polyvinyl chloride, polycarbonate, polypropylene and polyethylene.

3. The antenna device as set forth in claim 1, wherein the insulative sheet includes:

a first film comprised of non-conductive polymer and having a third face;

a metallic conductive film which is vapor-deposited on the third face; and a second film comprised of the non-conductive polymer, covering the metallic conductive film and integrally laminated on the third face.

4. The antenna device as set forth in claim 1, wherein the insulative sheet includes:

a sheet-shaped electromagnetic shielding member comprised of magnetic substance powder hardened by high polymer material; and sheet-shaped insulative member comprised of non-conductive material and integrally laminated on both faces of the electromagnetic shielding sheet.

5. The antenna device as set forth in claim 1, wherein the antenna element is comprised of a metal sheet; and the ground sheet, the insulative sheet, and the circuit board are formed integrally.

6. The antenna device as set forth in claim 1, wherein the insulative sheet is flexible.

* * * * *